US007982631B2

(12) United States Patent
Schwartz et al.

(10) Patent No.: US 7,982,631 B2
(45) Date of Patent: Jul. 19, 2011

(54) LED EMITTER FOR OPTICAL TRAFFIC CONTROL SYSTEMS

(75) Inventors: Mark Schwartz, River Falls, WI (US); Timothy Hall, Hudson, WI (US)

(73) Assignee: Global Traffic Technologies, LLC, St. Paul, MN (US)

( * ) Notice: Subject to any disclaimer, the term of this patent is extended or adjusted under 35 U.S.C. 154(b) by 294 days.

(21) Appl. No.: 12/407,349

(22) Filed: Mar. 19, 2009

(65) Prior Publication Data

US 2011/0115409 A1 May 19, 2011

Related U.S. Application Data

(63) Continuation-in-part of application No. 12/139,959, filed on Jun. 16, 2008, now Pat. No. 7,808,401.

(51) Int. Cl.
*G08B 5/00* (2006.01)

(52) U.S. Cl. ..... 340/815.45; 340/815.53; 340/825.22; 340/3.7; 340/3.1; 345/31; 345/82; 362/249.02; 362/253; 362/362; 362/373; 362/545

(58) Field of Classification Search ..... 340/815.45, 340/815.53, 825.22, 3.1, 3.7; 345/31, 82; 362/249.02, 253, 362, 373, 545
See application file for complete search history.

(56) References Cited

U.S. PATENT DOCUMENTS

| | | | | |
|---|---|---|---|---|
| 5,172,113 | A | 12/1992 | Hamer | 340/907 |
| 5,187,476 | A | 2/1993 | Hamer | 340/906 |
| 5,661,374 | A * | 8/1997 | Cassidy et al. | 315/307 |
| 6,299,337 | B1 * | 10/2001 | Bachl et al. | 362/545 |
| 7,411,174 | B2 * | 8/2008 | Eash | 250/221 |
| 7,429,917 | B2 | 9/2008 | Fredericks et al. | 340/464 |

* cited by examiner

*Primary Examiner* — Tai T Nguyen
(74) *Attorney, Agent, or Firm* — Crawford Maunu PLLC

(57) ABSTRACT

A light emitter for a traffic control preemption system. The emitter includes a plurality of groups of infrared (IR) LEDs and a power source coupled to the groups of LEDs. A plurality of controlled current sources is coupled to the plurality of groups of LEDs, respectively. A controller is configured to trigger an IR light pulse pattern from the groups of LEDs and maintain a first level of IR radiant power from the groups of LEDs using individual control of respective current levels to the groups of LEDs in response to current sense levels from the groups of LEDs. The pulse pattern and first level of IR radiant power activate preemption in the traffic control preemption system.

19 Claims, 3 Drawing Sheets

LED EMITTER FOR OPTICAL TRAFFIC CONTROL SYSTEMS

RELATED PATENT DOCUMENTS

This patent document is a continuation-in-part of and claims the benefit, under 35 U.S.C. §120, of U.S. patent application Ser. No. 12/139,959 filed Jun. 16, 2008, now U.S. Pat. No. 7,808,401 and entitled: "LIGHT EMITTERS FOR OPTICAL TRAFFIC CONTROL SYSTEMS," which is fully incorporated herein by reference.

FIELD OF THE INVENTION

The present invention is generally directed to systems and methods that allow traffic signals to be controlled from an authorized vehicle or portable unit.

BACKGROUND

Traffic signals have long been used to regulate the flow of traffic at intersections. Generally, traffic signals have relied on timers or vehicle sensors to determine when to change traffic signal lights, thereby signaling alternating directions of traffic to stop, and others to proceed.

Emergency vehicles, such as police cars, fire trucks and ambulances, generally have the right to cross an intersection against a traffic signal. Emergency vehicles have in the past typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

Traffic control preemption systems assist authorized vehicles (police, fire and other public safety or transit vehicles) through signalized intersections by making a preemption request to the intersection controller. The controller will respond to the request from the vehicle by changing the intersection lights to green in the direction of the approaching vehicle. This system improves the response time of public safety personnel, while reducing dangerous situations at intersections when an emergency vehicle is trying to cross on a red light. In addition, speed and schedule efficiency can be improved for transit vehicles.

There are presently a number of known traffic control preemption systems that have equipment installed at certain traffic signals and on authorized vehicles. One such system in use today is the OPTICOM® system. This system utilizes a high power strobe tube (emitter), which is located in or on the vehicle, that generates light pulses at a predetermined rate, typically 10 Hz or 14 Hz. A receiver, which includes a photodetector and associated electronics, is typically mounted on the mast arm located at the intersection and produces a series of voltage pulses, the number of which are proportional to the intensity of light pulses received from the emitter. The emitter generates sufficient radiant power to be detected from over 2500 feet away. The conventional strobe tube emitter generates broad spectrum light. However, an optical filter is used on the detector to restrict its sensitivity to light only in the near infrared (IR) spectrum. This minimizes interference from other sources of light.

SUMMARY

The various embodiments of the invention provide various approaches for activating a traffic control preemption system.

In one embodiment, a light emitter includes a plurality of groups of infrared (IR) LEDs and a power source coupled to the groups of LEDs. A plurality of controlled current sources is coupled to the plurality of groups of LEDs, respectively. A controller is configured to trigger an IR light pulse pattern from the groups of LEDs and maintain a first level of IR radiant power from the groups of LEDs using individual control of respective current levels to the groups of LEDs in response to current sense levels from the groups of LEDs. The pulse pattern and first level of IR radiant power activate preemption in the traffic control preemption system.

DETAILED DESCRIPTION

The embodiments of the present invention include IR LED's in an emitter that uses much less power than conventional strobe tube emitters and does not degrade in intensity as do strobe tube emitters. Conventional strobe tube emitters require significant power to operate (~25 W), and much of the power is used to generate light in bandwidths outside the IR bandwidth used by the photodetector in the traffic control preemption system. The intensity of strobe tubes degrades significantly over time, thereby reducing the effectiveness of the overall system since the activation distance is reduced, resulting in a corresponding reduction in the amount of time to clear an intersection before an emergency vehicle arrives. The conventional strobe tube and high voltage power supply are also difficult to fabricate in a low profile form factor, which is desirable for emergency vehicle lightbars.

The LED emitter in the embodiments of the current invention uses significantly less power than strobe tube emitters and provides consistent intensity, thereby providing consistent effectiveness in preempting traffic control systems. A controller is used to trigger the light pulses from multiple groups of IR LEDs in a pattern to activate preemption in the traffic control preemption system. The trigger is applied to respective current sources which are coupled to the groups of LEDs. Each of the current sources feeds back a current sense level from the respective group of LEDs to the controller. The controller, in response to the sensed current levels from the groups of LEDs, maintains the level of IR radiant power from the groups of LEDs at a level sufficient to activate preemption in the traffic control preemption system. Thus, the ability to monitor performance of each group of LEDs and precisely control the current not only provides consistent intensity, but also provides improved reliability over the loss of intensity and single points of failure found in conventional strobe tube emitters.

Figure 1:
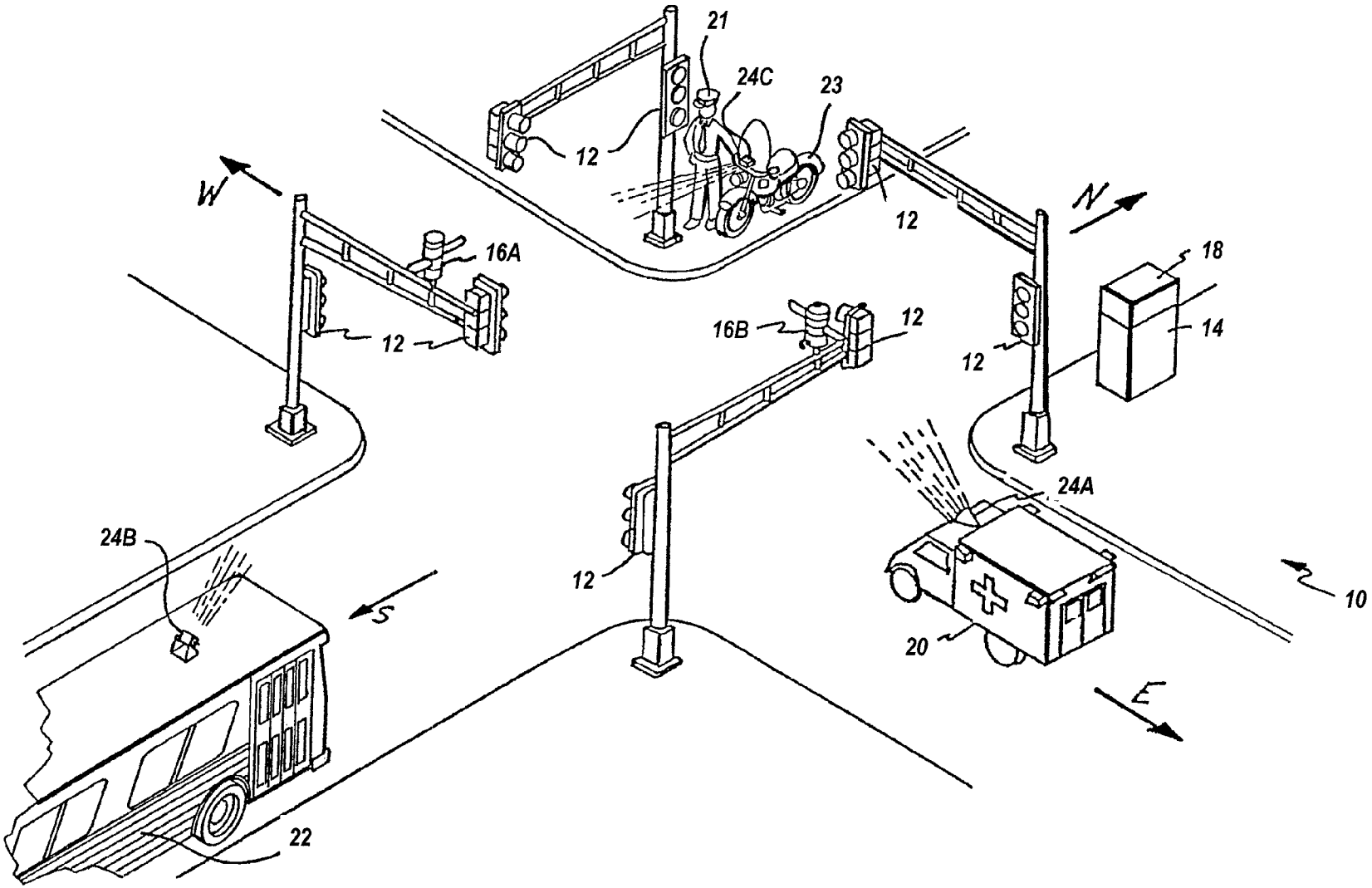
FIG. 1 is an illustration of a typical intersection having traffic signal lights, which illustrates the environment in which embodiments of the present invention may be used.

FIG. 1 is an illustration of a typical intersection 10 having traffic signal lights 12. The equipment at the intersection illustrates the environment in which embodiments of the present invention may be used. A traffic signal controller 14 sequences the traffic signal lights 12 to allow traffic to proceed alternately through the intersection 10. In one embodiment, the intersection 10 may be equipped with a traffic control preemption system such as the OPTICOM® Priority Control System. In addition to the general description provided below, U.S. Pat. No. 5,172,113 to Hamer, which is incorporated herein by reference, provides further operational details of the example traffic control preemption system shown in FIG. 1.

The traffic control preemption system shown in FIG. 1 includes detector assemblies 16A and 16B, optical emitters 24A, 24B and 24C and a phase selector 18. The detector assemblies 16A and 16B are stationed to detect light pulses emitted by authorized vehicles approaching the intersection 10. The detector assemblies 16A and 16B communicate with the phase selector 18, which is typically located in the same cabinet as the traffic controller 14.

In FIG. 1, an ambulance 20 and a bus 22 are approaching the intersection 10. The optical emitter 24A is mounted on the ambulance 20 and the optical emitter 24B is mounted on the bus 22. The optical emitters 24A and 24B each transmit a stream of light pulses that are received by detector assemblies 16A and 16B. The detector assemblies 16A and 16B send output signals to the phase selector 18. The phase selector 18 processes the output signals from the detector assemblies 16A and 16B to validate that the light pulses are at the correct activation frequency and intensity (e.g., 10 or 14 Hz), and if the correct frequency and intensity are observed the phase selector generates a preemption request to the traffic signal controller 14 to preempt a normal traffic signal sequence.

FIG. 1 also shows an authorized person 21 operating a portable optical emitter 24C, which is shown mounted to a motorcycle 23. In one embodiment, the emitter 24C is used to set the detection range of the optical traffic preemption system. In another embodiment, the emitter 24C is used by the person 21 to affect the traffic signal lights 12 in situations that require manual control of the intersection 10.

In one configuration, the traffic preemption system may employ a preemption priority level. For example, the ambulance 20 would be given priority over the bus 22 since a human life may be at stake. Accordingly, the ambulance 20 would transmit a preemption request with a predetermined repetition rate indicative of a high priority, such as 14 pulses per second, while the bus 20 would transmit a preemption request with a predetermined repetition rate indicative of a low priority, such as 10 pulses per second. The phase selector would discriminate between the low and high priority signals and request the traffic signal controller 14 to cause the traffic signal lights 12 controlling the ambulance's approach to the intersection to remain or become green and the traffic signal lights 12 controlling the bus's approach to the intersection to remain or become red.

The phase selector alternately issues preemption requests to and withdraws preemption requests from the traffic signal controller, and the traffic signal controller determines whether the preemption requests can be granted. The traffic signal controller may also receive preemption requests originating from other sources, such as a nearby railroad crossing, in which case the traffic signal controller may determine that the preemption request from the other source be granted before the preemption request from the phase selector. However, as a practical matter, the preemption system can affect a traffic intersection and create a traffic signal offset by monitoring the traffic signal controller sequence and repeatedly issuing phase requests that will most likely be granted.

The various embodiments of the invention provide a variety of options for remotely controlling traffic signals. In one embodiment, an authorized person (such as person 21 in FIG. 1) can remotely control a traffic intersection during situations requiring manual traffic control, such as funerals, parades or athletic events, by using the emitter described herein. In this embodiment the emitter has a keypad, joystick, toggle switch or other input device which the authorized person uses to select traffic signal phases. The emitter, in response to the information entered through the input device, transmits a stream of light pulses which include an operation code representing the selected traffic signal phases. In response to the operation code, the phase selector will issue preemption requests to the traffic signal controller, which will probably assume the desired phases.

In another scenario, the emitter may be used by field maintenance workers to set operating parameters of the traffic preemption system, such as the effective range. For example, the maintenance worker positions the emitter at the desired range and transmits a range setting code. The phase selector then determines the amplitude of the optical signal and uses this amplitude as a threshold for future transmissions, except transmissions having a range setting code.

The existing system described above has been used for many years and works well, however the conventional strobe tube emitter requires significant power to operate (30 W) and much of the power is used to generate light in bandwidths that are not used by the photo detector. The conventional strobe tube uses a xenon lamp and its high voltage power supply is large and also difficult to fabricate in low profile form factors. Typically, strobe tube emitters are mounted on the roof of the emergency vehicle due to their size. However, roof mounting has the potential of interfering with or limiting the locations of other equipment on the emergency vehicle, and may be subject to damage. Typical strobe tube emitters also are quite visible due to their size, thereby undesirably drawing attention to unmarked emergency vehicles.

The optical detector circuitry used in OPTICOM® traffic preemption systems at the intersection creates a series of pulses proportional to the intensity of the near infrared spectrum incident light pulses generated by the emitter. This is shown and described in detail in U.S. Pat. No. 5,187,476 OPTICAL TRAFFIC PREEMPTION DETECTOR CIRCUITRY by Steven Hamer, which is incorporated herein by reference. The detector circuitry utilizes a rise time filter to isolate the step current pulse generated by the photo detector in response to the light pulse. The current pulse is converted to a voltage pulse and routed through a band-pass filter (BPF) which works over a range with a center frequency of about 6.5 KHz. The output signal of the BPF is a 6.5 KHz decaying sinusoidal waveform with an amplitude and duration that is proportional to the amplitude of the input pulse. The width of the input pulse can also change the number of voltage pulses that are output, however there are diminishing returns as the pulse width is increased because the 6.5 kHz content of the pulse does not increase proportionally to the pulse width, and a pulse width wider than about 50 μs has essentially no additional 6.5 kHz content.

Figure 2:
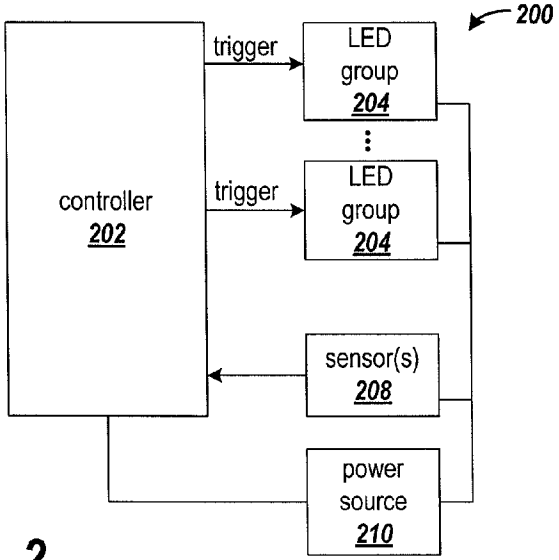
FIG. 2 is a functional block diagram of an example LED emitter in accordance with various embodiments of the invention.

FIG. 2 is a functional block diagram of an example LED emitter in accordance with various embodiments of the invention. The controller 202 triggers multiple LED groups 204 to emit light pulses in a pattern and of a radiant power level sufficient to activate the traffic control preemption. The number of LEDs in each group depends on the size and the level of radiant power each LED can emit. A power source 210 is coupled to the controller, LED groups, and sensor(s). The pattern of light pulses triggered by the controller is that which activates the traffic control preemption. An example detector is an OPTICOM Model 711 detector for which an example pulse of suitable radiant power is 100 nW for 40 μs. The incident energy for this pulse can be calculated as 100 nW×40 uS=4E-12 joules.

One or more sensors 208 provide feedback signals to the controller 202. In response to the feedback signal(s), the controller makes any adjustment to the triggering of the LED groups that may be necessary for maintaining a suitable level of radiant power from the collection of LED groups. The sensors may provide signals that indicate an operating temperature, respective current levels of the LED groups, and the IR radiant power level, for example. The feedback of current levels and adjustment by the controller allows the LED emitter to remain effective in activating preemption of the traffic control system should one or more of the groups of LEDs fail, whereas a strobe tube emitter would be ineffective.

In certain specific embodiments, multiple LED devices are used to create the preemption request signal for a traffic control preemption system. LEDs have an advantage of emitting light in a very narrow band of wavelengths, which can be matched to the characteristics of the detector for maximum efficiency. Although any wavelength of light may be used by suitable selection of LEDs and detector or detector filter sensitivities, infrared LEDs may be preferred for many applications. This is because the use of infrared light avoids interference from other light sources. Also, there is a practical advantage to infrared LEDs because a large number of installed traffic control systems, for example, the OPTICOM® systems, use an infrared filter over their detectors. Thus, the use of the corresponding wavelength of LED emitters leads to greater compatibility without requiring modifications to existing systems. It will be appreciated that other implementations may find a combination of infrared and visible light LEDs to be useful in the emitter. Furthermore, because the power consumed by LEDs is much lower than the conventional high-powered strobe tubes used in conventional preemption request emitters, the electrical load on vehicle alternators is reduced, as is the unwanted production of heat.

In an example implementation, LEDs having a peak wavelength, $\lambda_p$=890 nm, an angle of half intensity, $\phi=\pm 10°$, and a power dissipation 180 mW have been found to be useful. Those skilled in the art recognize that the characteristics of the LED will vary from application to application.

The angle of dispersion of the generated IR light from the LEDs is preferably controlled for optimum near and far range operation. Discrete LEDs may have plastic encapsulation with lenses formed thereon to disperse emitted light. Alternatively, individual lenses or large lenses may be fitted over the desired LEDs to provide the desired dispersion. In order to emit sufficient radiant power from a distance, some number of the LEDs are provided with lenses having a relatively narrow dispersion angle. The number and angle of view will depend on the radiant power of individual LEDs and the desired distance. In one embodiment, others of the LEDs are provided with lenses having a relatively wider dispersion angle to ensure that sufficient light is aimed upward to reach the detectors as the vehicle approaches close to controlled road. In another embodiment, the LEDs may be outfitted with lenses having the same dispersion angle that permits light to reach the detector as the vehicle approaches close to controlled road, and the LEDs may be sufficiently powered to emit pulses that would activate the detector from the desired distance. It will be appreciated that various combinations of lenses having different dispersion angles may be used to satisfy implementation requirements. The lenses provide minimal side dispersion of light to prevent unwanted side street activations. In an example implementation, LEDs having a dispersion angle of +/−10 degrees provide a reasonable approximation to the performance of a prior xenon tube emitter from Opticom for both curved and straight approaches to the controlled road.

It will be appreciated that supporting structure for the LED emitter 200 may take various forms according to design objectives. For example, the LED emitter may be intended for use as a standalone, handheld device. In such a handheld device the control circuitry and LEDs may be powered with a power source as small as a conventional nine-volt battery. In another embodiment, the emitter is intended for mounting to various locations on a vehicle. Various locations on a vehicle to which the light emitter can be mounted include, for example, the hood area as indicated, grille area, windshield area, dashboard area, or behind the mirror or sun visor or any other location where light from the emitter projects forward. Also, LEDs may be mounted along or around the windshield frame, either inside or outside the vehicle. It will be appreciated that depending on placement of the light emitter, such as behind a windshield that absorbs IR, additional power or pulses may be needed to compensate. In yet another embodiment, the emitter is constructed as a module for mounting with other components of a light bar.

Those skilled in the art will recognize that the controller 202 may be configured to work within various traffic control preemption systems, such as the OPTICOM system referenced above or within the STROBECOM systems (manufactured by TOMAR Electronics, Inc.).

Figure 3:
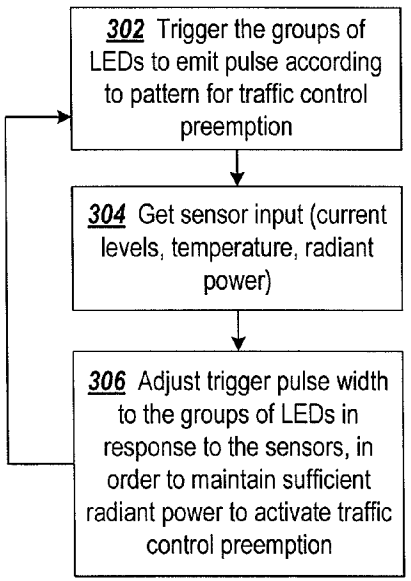
FIG. 3 is a flowchart of an example process performed by an LED emitter in accordance with one or more embodiments of the invention.

FIG. 3 is a flowchart of an example process performed by an LED emitter in accordance with one or more embodiments of the invention. A controller triggers groups of IR LEDs to emit a pulse according to a pattern for traffic control preemption at step 302. In one embodiment, the controller gets input from one or more sensors following each pulse at step 304. In response to the sensor input, the controller adjusts the trigger, if needed, to the LED groups in order to maintain sufficient radiant power to activate traffic control preemption at step 306. In one embodiment, the trigger to the LED groups may be adjusted by controlling the pulse width and amplitude of the trigger signal applied to the LED groups.

The control of the radiant intensity level of the LED groups may be further used to signal priority levels for different types of vehicles. For example, the controller may trigger lower intensity emissions for lower priority vehicles, such as mass transit, and higher intensity emissions for higher priority vehicles, such as emergency vehicles. The desired intensity level may be specified by way of a programmable configuration parameter to the controller, and the controller triggers the LED groups according to the programmed intensity level. Thus, the controller is programmable to trigger different intensity levels, and different instances of the same LED emitter may be programmed for use in different types of vehicles.

The LEDs can be flashed at a much higher rate than a conventional strobe. The higher flash rate of the LEDs can be used to generate more sophisticated coding than is possible with conventional strobe tubes where flash rates are limited due to high power requirements and power supply size. For example, additional data such as vehicle turn signal status may be encoded in the flash pattern. This information could be used to manipulate the traffic signal lights based on the desired turning direction of the approaching vehicle.

In another embodiment, the controller is configured to trigger a subset of the groups of LEDs with each pulse, thereby reducing the operation time of the LEDs. Reducing the operation time provides an increase in the useful life of the emitter as a whole.

In addition or as an alternative to adjusting the trigger pulse width in response to sensor feedback, the controller may count the number of times that each group of LEDs is triggered and adjust the trigger pulse width or amplitude accordingly. For example, the radiant power output of an LED will decrease over a large number of flashes, and certain LEDs may have been qualified to emit at certain levels of radiant power for corresponding threshold numbers of flashes. The controller may be programmed to adjust the trigger pulse width or amplitude to achieve the desired level of radiant power from the LEDs when each threshold is reached. The count of flashes may be stored in a non-volatile memory (not shown) when the emitter is powered off, for example, in order to preserve the count across power on-off cycles.

Figure 4:
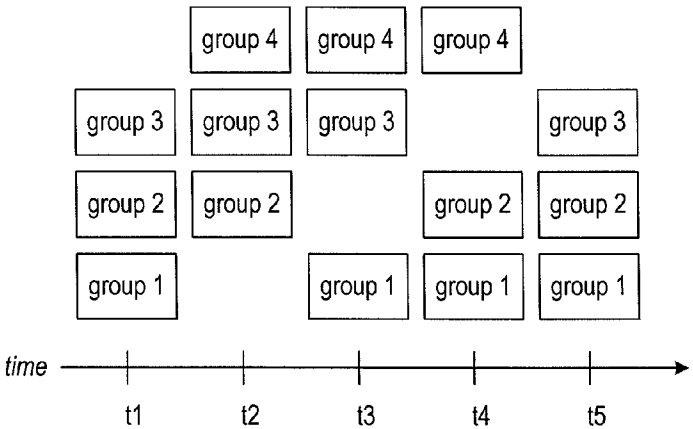
FIG. 4 is a graph that shows a sequence in which selected groups of LEDs are triggered at each trigger time.

FIG. 4 is a graph that shows a sequence in which selected groups of LEDs are triggered at each trigger time. According to one embodiment of the invention, there are multiple groups of LEDs, and selected ones of the groups, but fewer than all of the groups, are triggered for emitting each pulse. The example assumes there are four groups of LEDs. Three of the four groups of LEDs are triggered at each trigger time. At time t1, LED groups 1, 2, and 3 are triggered; at time t2, groups 2, 3, and 4 are triggered; at time t3, groups 1, 3, and 4 are triggered; and at time t4, groups 1, 2, and 4 are triggered. At trigger 5, the cycle repeats with triggering of groups 1, 2, and 3.

In another embodiment, the LED emitter may be constructed with one or more spare groups of LEDs. The controller would not trigger the spare LED group(s) until one of the other groups of LEDs failed. Once another LED group fails, the spare LED group would be triggered according to the desired pulse pattern.

Triggering different groups of LEDs at different times may be used to provide a higher data rate for encoding data with the emitted light pulses in another embodiment. For example, a first trigger may be used to trigger LED groups 1, 2, and 3, and a second trigger may be used to trigger groups 4, 5, and 6. A light pulse from groups 4, 5, and 6 may be triggered much closer in time to a prior triggering of a light pulse from groups 1, 2, and 3 where the groups are separately triggered than where the one trigger is used for both groups 1, 2, and 3 and for groups 4, 5, and 6.

Figure 5:
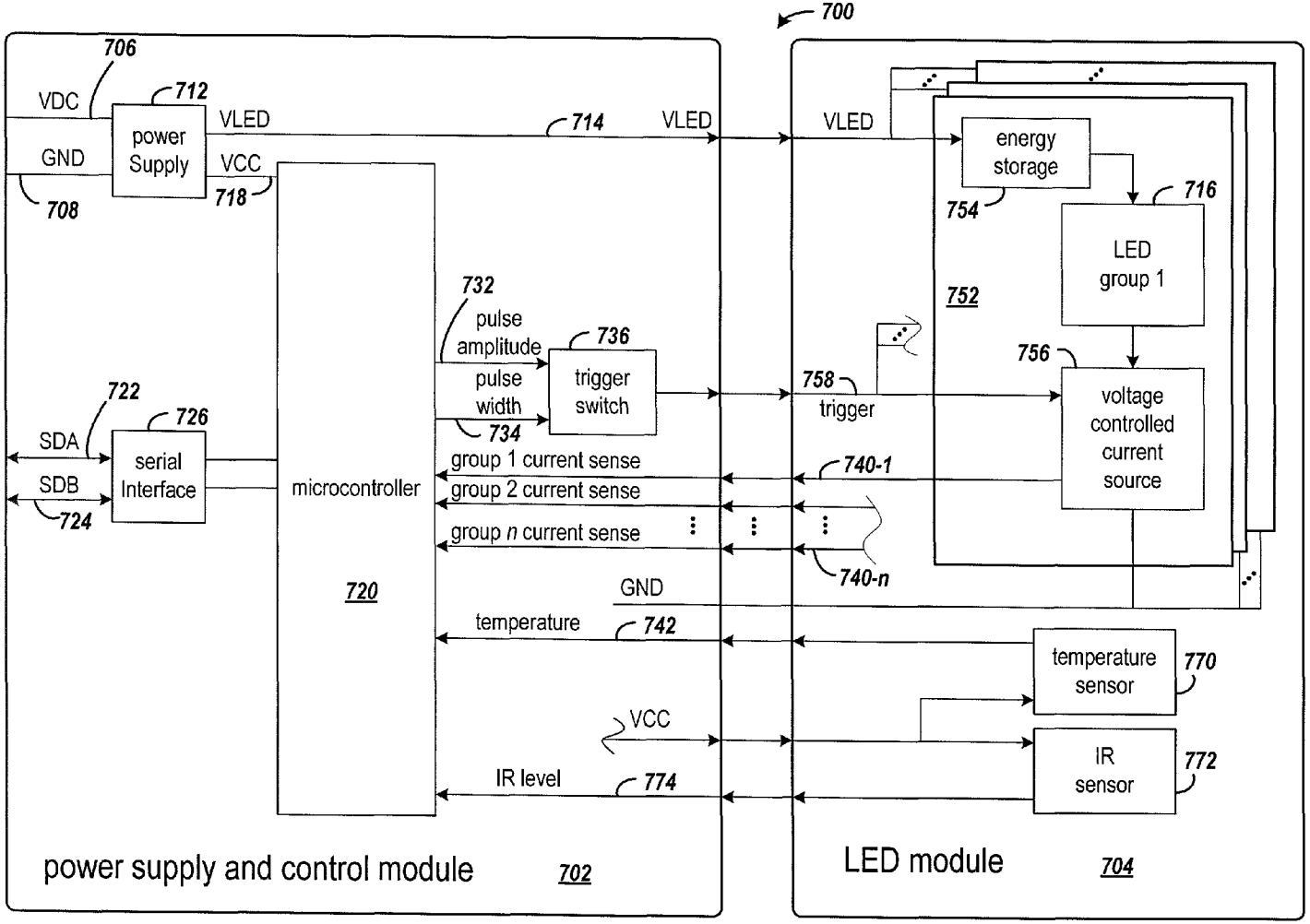
FIG. 5 is a functional block diagram of a circuit arrangement for controlling and driving a plurality of groups of LEDs in accordance with one or more embodiments of the invention.

FIG. 5 is a functional block diagram of a circuit arrangement 700 for controlling and driving a plurality of LEDs in accordance with one or more embodiments of the invention. The power supply/control module is referenced as 702, and the LED array module is referenced as 704. Module 702 has suitable connectors (not shown) for coupling to vehicle power 706 and ground 708, which connection can also be used by a switch (not shown) in the vehicle to turn on and off the emitter. Those skilled in the art will recognize suitable connectors and switches for different specific implementations. Vehicle DC is applied to power supply 712, which provides the voltage supply, VLED 714, for driving the LEDs 716, and also logic level voltage, VCC 718, for microcontroller 720. An example suitable power supply operates from an input voltage range of 10 VDC to 32 VDC. Note that for ease of explanation, each signal and the line carrying that signal are referred to by the same name and reference number. Serial connections 722 and 724 are also provided to serial interface 726 which also connects to microcontroller 720. The external serial interfaces SDA and SDB provide an interface to set an ID code that will be transmitted by the emitter. The serial interface can also be used to change the pulse characteristics and provides an interface to update the firmware code.

Microcontroller 720 is a programmed microprocessor which outputs pulse amplitude control 732 and pulse width control 734 to trigger switch 736. Microcontroller 720 also receives LED current sense signals **740-1-740-*n* and temperature signal 742 from the LED module 704**. In an example implementation a microcontroller such as the PIC24 16-bit microcontroller from MICROCHIP® Technology, Inc., has been found to be useful.

Power supply and control module 702 is connected to LED array module 704 by connectors suitable for the implementation. Those skilled in the art will recognize that whether the light emitter is constructed as a single unit or as multiple modules will depend on implementation-specific form factor restrictions. In an example implementation the power supply and control module and LED modules meet the form factor restrictions of a length ≦6", a height ≦1.5", and a depth ≦2".

The LED module 704 includes multiple channels of LEDs (e.g., 8 in one implementation). Block 752 depicts one of the multiple channels. In an example embodiment, the elements shown in block 752 (or general equivalents) are replicated in each of the other channels. The high voltage (for example, 40 volts) VLED 714 is coupled to an energy storage element 754 which in turn is coupled to the group 1 LEDs (block 716). In an example embodiment, the energy storage element 754 is a capacitor, e.g., 220 μF and 50 VDC. The VLED 714 is coupled to respective energy storage elements in each of the channels.

In an example implementation, the LEDs in each channel, for example, LED group 1 (block 716) includes a plurality of LEDs connected in series. A greater or smaller number of LEDs may be used with corresponding changes to the voltage and power supplied. The last LED in the series is coupled to a switchable voltage controlled current source 756, such as a conventional op-amp and power transistor configuration. The trigger signal 758 is applied from trigger switch 736 to the voltage controlled current source 756, and a current sense signal 740-1 is fed back to microcontroller 720. A respective current sense signal is fed back to the microcontroller from each of the channels, for example, group 1 current sense signal 740-1 from the first channel, and group n current sense signal **740-*n* from the nth channel. In an example embodiment, the trigger switch 736 is a single pole double throw (SPDT) type analog switch with a turn-on and turn-off time of less than 50 ns and a supply voltage of 3.3 V. Depending on design objectives, a single switch may be used to control all the groups of LEDs, or multiple switches may be used. In response to a lack of current in a defective channel, the microcontroller 720** increases the current in the remaining operational channels to compensate for the loss of radiant power in the defective channel.

A temperature sensor 770 provides the temperature signal 742, which represents the temperature conditions within the LED module, to the microcontroller 720. An example temperature sensor suitable for use with the example microcontroller 720 is the MCP9700 sensor from MICROCHIP® Technology, Inc. In response to the temperature falling below or rising above certain thresholds, the microcontroller adjusts the pulse amplitude and pulse width to compensate for the variation of LED radiant power due to operating temperature. For example, the amplitude and/or pulse width may be varied +/−20% as the temperature approaches a low of −35 C or a high of 75 C.

In another embodiment, an IR sensor 772 is disposed to receive the IR pulses from the LED groups and coupled to the controller for providing an IR level signal 774 in response to the sensed IR level. In one embodiment, IR sensors comparable to those commonly used in television remote control applications may be suitable for use with the LED emitter. Multiple IR sensors may be mounted at several locations in the IR array to detect the intensity that would be proportional to the emitter intensity. The sensors may be mounted at a right angle relative to the array of IR LEDs or mounted directly in the array to detect reflected IR from a lens positioned to protect the LEDs.

The sensed IR level indicates the total radiant power emitted from the triggered LED groups. In response to the sensed IR level, the controller adjusts the pulse amplitude 732 and pulse width 734 to maintain the desired level of radiant power.

The present invention is thought to be applicable to a variety of systems for controlling the flow of traffic. Other aspects and embodiments of the present invention will be apparent to those skilled in the art from consideration of the specification and practice of the invention disclosed herein. It is intended that the specification and illustrated embodiments be considered as examples only, with a true scope and spirit of the invention being indicated by the following claims.

We claim:

1. A light emitter for a traffic control preemption system, comprising:

a plurality of groups of infrared (IR) LEDs, each group including one or more IR LEDs;

a power source coupled to the groups of LEDs;

a plurality of controlled current sources coupled to the plurality of groups of LEDs, respectively; and a controller coupled to the plurality of controlled current sources, wherein the controller is configured to trigger an IR light pulse pattern from the groups of LEDs and maintain a first level of IR radiant power from the groups of LEDs using individual control of respective current levels to the groups of LEDs in response to current sense levels from the groups of LEDs, wherein the pulse pattern and first level of IR radiant power activate preemption in the traffic control preemption system.

2. The light emitter of claim 1, wherein the controller is further configured, responsive to the current sense level from one of the groups of LEDs indicating to the controller that the one group of LEDs has failed, to increase the respective current levels to the groups of LEDs other than the failed group of LEDs.

3. The light emitter of claim 1, further comprising a temperature sensor proximate the groups of LEDs and coupled to the controller, wherein the controller is further configured, responsive to a temperature level from the temperature sensor, to adjust the respective current levels to the groups of LEDs.

4. The light emitter of claim 1, wherein the controller is further configured to trigger a subset of the groups of LEDs for each pulse of the pulse pattern, the subset including fewer than all of the groups of LEDs.

5. The light emitter of claim 1, further comprising:

an IR sensor coupled to the controller, wherein the IR sensor is configured to receive the IR pulse pattern from the groups of LEDs and output a sensed level of IR radiant power of the groups of LEDs; and wherein the controller is further configured to adjust respective current levels to the groups of LEDs in response to the sensed level of IR radiant power for maintaining the first level of IR radiant power.

6. The light emitter of claim 1, wherein the controller is configurable with a parameter for specifying different levels of IR radiant power.

7. The light emitter of claim 1, wherein the pulse pattern that activates preemption in the traffic control preemption system is a first pulse pattern, and the controller is further configured to trigger a second IR light pulse pattern from the groups of LEDs, and the second pulse pattern is different from the first pulse pattern.

8. The light emitter of claim 1, further comprising a plurality of respective pulse energy storage devices, each coupled to the power source and to a respective one of the groups of LEDs.

9. The light emitter of claim 1, wherein the controlled current source is a voltage controlled current source.

10. The light emitter of claim 1, wherein the controller is further configured to count a number of pulses emitted by each group of LEDs and responsive to the count reaching a threshold, to increase the respective current levels to the groups of LEDs.

11. A light emitter for a traffic control preemption system, comprising:

a plurality of groups of infrared (IR) LEDs, each group including one or more IR LEDs;

a plurality of capacitors coupled to the groups of LEDs, respectively;

a power source coupled to capacitors;

a plurality of controlled current sources coupled to the plurality of groups of LEDs, respectively;

at least one trigger switch coupled to the controlled current sources; and a microcontroller coupled to the at least one trigger switch, wherein the microcontroller is configurable with a parameter for specifying different levels of IR radiant power and is configured to trigger an IR light pulse pattern from the groups of LEDs and maintain a first level of IR radiant power from the groups of LEDs using individual control of respective current levels to the groups of LEDs in response to current sense levels from the groups of LEDs, wherein the pulse pattern and first level of IR radiant power activate preemption in the traffic control preemption system.

12. The light emitter of claim 11, wherein the microcontroller is further configured, responsive to the current sense level from one of the groups of LEDs indicating to the microcontroller that the one group of LEDs has failed, to increase the respective current levels, via the at least one trigger switch, to the groups of LEDs other than the failed group of LEDs.

13. The light emitter of claim 11, further comprising a temperature sensor proximate the groups of LEDs and coupled to the microcontroller, wherein the microcontroller is further configured, responsive to a temperature level from the temperature sensor, to adjust the respective current levels to the groups of LEDs via the at least one trigger switch.

14. The light emitter of claim 11, wherein the microcontroller is further configured to trigger a subset of the groups of LEDs for each pulse of the pulse pattern, the subset including fewer than all of the groups of LEDs.

15. The light emitter of claim 11, further comprising:

an IR sensor coupled to the microcontroller, wherein the IR sensor is configured to receive the IR pulse pattern from the groups of LEDs and output a sensed level of IR radiant power of the groups of LEDs; and wherein the microcontroller is further configured to adjust respective current levels to the groups of LEDs via the at least one trigger switch in response to the sensed level of IR radiant power for maintaining the first level of IR radiant power.

16. The light emitter of claim 11, wherein the pulse pattern that activates preemption in the traffic control preemption system is a first pulse pattern, and the microcontroller is further configured to trigger a second IR light pulse pattern from the groups of LEDs, and the second pulse pattern is different from the first pulse pattern.

17. The light emitter of claim 11, wherein the controlled current source is a voltage controlled current source.

18. The light emitter of claim 11, wherein the microcontroller is further configured to count a number of pulses emitted by each group of LEDs and responsive to the count reaching a threshold, to increase the respective current levels to the groups of LEDs via the at least one trigger switch.

19. A light emitter for a traffic control preemption system, comprising:

a plurality of groups of infrared (IR) LEDs, each group including one or more IR LEDs;

means for providing power to the groups of LEDs;

means for controlling current to the plurality of groups of LEDs; and programmable means for triggering an IR light pulse pattern from the groups of LEDs and for maintaining a first level of IR radiant power from the groups of LEDs using individual control of respective current levels to the groups of LEDs in response to current sense levels from the groups of LEDs, wherein the pulse pattern and first level of IR radiant power activate preemption in the traffic control preemption system.

* * * * *